US009895878B2

(12) United States Patent
Kobayashi et al.

(10) Patent No.: US 9,895,878 B2
(45) Date of Patent: Feb. 20, 2018

(54) LIQUID DROPLET EJECTING APPARATUS

(71) Applicant: SEIKO EPSON CORPORATION, Tokyo (JP)

(72) Inventors: Hiroyuki Kobayashi, Shimosuwa-machi (JP); Yuichi Honobe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/454,153

(22) Filed: Mar. 9, 2017

(65) Prior Publication Data

US 2017/0173941 A1 Jun. 22, 2017

Related U.S. Application Data

(63) Continuation of application No. 15/053,173, filed on Feb. 25, 2016, now Pat. No. 9,616,686.

(30) Foreign Application Priority Data

Mar. 27, 2015 (JP) ..... 2015-065927

(51) Int. Cl.
*B41J 2/045* (2006.01)

(52) U.S. Cl.
CPC ..... *B41J 2/04508* (2013.01); *B41J 2/04586* (2013.01)

(58) Field of Classification Search
CPC ..... B41J 2/04508; B41J 2/04586
See application file for complete search history.

(56) References Cited

U.S. PATENT DOCUMENTS

| | | | | |
|---|---|---|---|---|
| 9,616,686 | B2 * | 4/2017 | Kobayashi | B41J 11/0095 |
| 2007/0109338 | A1 | 5/2007 | Niioka | |
| 2007/0195119 | A1 | 8/2007 | Niimi | |
| 2013/0044178 | A1 | 2/2013 | Tsuchiya et al. | |
| 2013/0229454 | A1 | 9/2013 | Yatsunami | |
| 2013/0257973 | A1 | 10/2013 | Tamura | |
| 2013/0278664 | A1 | 10/2013 | Arakane et al. | |

FOREIGN PATENT DOCUMENTS

| | | | |
|---|---|---|---|
| JP | 2007-223074 | A | 9/2007 |
| JP | 2009-039952 | A | 2/2009 |
| JP | 2012-166352 | A | 9/2012 |
| JP | 2013-202897 | A | 10/2013 |

OTHER PUBLICATIONS

Notice of Allowance issued in U.S. Appl. No. 15/053,173 dated Dec. 8, 2016.
Office Action issued in U.S. Appl. No. 15/053,173 dated Jul. 7, 2016.

* cited by examiner

*Primary Examiner* — Alessandro Amari
*Assistant Examiner* — Roger W Pisha, II
(74) *Attorney, Agent, or Firm* — Workman Nydegger

(57) ABSTRACT

A printing apparatus (liquid droplet ejecting apparatus) includes a detector configured to output a first signal which denotes that a medium is not supported on a support face of a medium support unit, and a second signal which denotes that a medium is supported on the support face; and a controller that limits executing of a printing operation when the first signal in received and allows executing of a printing operation when the second signal is received. The controller is configured to ignore the first signal or interpret the first signal as the second signal under a specified condition.

4 Claims, 8 Drawing Sheets

LIQUID DROPLET EJECTING APPARATUS

CROSS-REFERENCE TO RELATED APPLICATION

This application claims priority under 35 U.S.C. § 119 to Japanese Patent Application No. 2015-065927, filed Mar. 27, 2015. The entire disclosure of Japanese Patent Application No. 2015-065927 is hereby incorporated herein by reference.

BACKGROUND

1. Technical Field

The present invention relates to a liquid droplet ejecting apparatus such as an ink jet printer.

2. Related Art

In the related art, an ink jet printer which forms characters or an image by ejecting ink as an example of liquid droplets onto a medium such as a T-shirt has been known as an example of a liquid droplet ejecting apparatus.

As such a printer, there is a printer which includes a medium support unit which supports a medium, a liquid droplet ejecting unit which ejects ink (liquid droplets) onto a medium, a reflection type detecting unit which radiates light toward the medium support unit, and receives reflected light of the light, and a carriage which performs a reciprocating movement in a width direction in a state of supporting the liquid droplet ejecting unit and the detecting unit (for example, JP-A-2007-223074).

In addition, in such a printer, whether or not a medium is supported on the medium support unit is determined based on a detection result of the detecting unit when the medium support unit and the detecting unit are caused to perform a relative movement. In addition, when it is determined that a medium is not supported on the medium support unit, a warning about the significance thereof is performed, and printing is not executed.

Meanwhile, according to a type of the detecting unit or a type of a medium which is supported on the medium support unit in the above described printer, there is a case in which it is determined that a medium is not supported on the medium support unit, even when the medium is supported on the medium support unit.

For example, when whether or not a medium is supported on the medium support unit is determined based on the difference in light intensity of reflected light (difference in intensity of received light) between a case in which the medium support unit is set to a detecting target and a case in which a medium which is supported on the medium support unit is set to a detecting target, there is a concern that the following problem may occur.

That is, when a color of the medium support unit (reflectivity) and a color of a medium (reflectivity) are approximately the same, there is a case in which the difference in light intensity of reflected light rarely occurs, and it is determined that a medium is not supported on the medium support unit, even when the medium is supported on the medium support unit. That is, there is a problem in that throughput of a printing apparatus decreases, since printing is not executed even without a problem in executing printing.

SUMMARY

An advantage of some aspects of the invention is to provide a liquid droplet ejecting apparatus which can suppress a decrease in throughput which is caused when ejecting of liquid droplets is limited even though a liquid droplet ejecting unit can eject liquid droplets onto a medium.

Hereinafter, means of the invention, and operational effects thereof will be described.

According to an aspect of the invention, there is provided a liquid droplet ejecting apparatus which includes a medium support unit having a support face configured to support a medium; a liquid droplet ejecting unit which executes an ejecting operation in which liquid droplets are ejected onto the medium; a detector configured to output a first signal which denotes that the medium is not supported on the support face, and a second signal which denotes that the medium is supported on the support face; and a controller that limits executing of the ejecting operation when the first signal is received and allows executing of the ejecting operation when the second signal is received, the controller being configured to ignore the first signal or interpret the first signal as the second signal under a specified condition.

According to the configuration, when the controller receives the second signal, it is possible to cause the liquid droplet ejecting ejector to eject liquid droplets regardless of a detection result of the detector. For this reason, it is possible to avoid a situation in which ejecting of liquid droplets using the liquid droplet ejecting ejector is limited due to an erroneous output of the first signal by the detector, even when a medium is supported on the medium support unit. Therefore, according to the configuration, it is possible to suppress a decrease in throughput in the liquid droplet ejecting apparatus. In addition, the throughput here means the number of mediums onto which liquid droplet can be ejected by the liquid droplet ejecting ejector per unit time, an area to which the liquid droplet ejecting ejector ejects liquid droplets per unit time, or the like.

It is preferable that the controller includes a first controller and a second controller. The first controller limiting executing of the ejecting operation when the first signal is received and allowing executing of the ejecting operation when the second signal is received. The second controller being configured to receive the first and second signals from the detector and being further configured to ignore the first signal or interpret the first signal as the second signal under the specified condition.

It is preferable that the specified condition is that a time obtained by the second controller is within an allowed time period when the first signal is received by the second controller.

When it is possible for a user to check that a medium is supported on the medium support unit, for example, when the user is around the liquid droplet ejecting apparatus, or the like, it is possible to suppress ejecting of liquid droplets onto the medium support unit on which the medium is not supported, even when an ejecting operation is executed regardless of a detection result of the detector. Therefore, according to the above described configuration, it is possible to suppress a decrease in throughput of the liquid droplet ejecting apparatus by causing the liquid droplet ejector to eject liquid droplets when there is no problem even if an ejecting operation is executed, for example, when an allowed time period which is controlled by the second controller is set to a time period in which a user is around the liquid droplet ejecting apparatus, or the like.

In the liquid droplet ejecting apparatus, it is preferable to further include an operation unit that is operated when an ejecting instruction is issued, and a receiver configured to receive. The specified condition is that the ejecting instruction is issued through the operation unit.

When an ejecting instruction is given through the operation unit of the liquid droplet ejecting apparatus, a user is around the apparatus; however, when the ejecting instruction is given through a terminal, there is a concern that the user may not exist around the apparatus.

According to the configuration, when an ejecting instruction is given through the operation unit, the signal output unit is allowed to output the second signal. That is, since it is possible for a user to check that a medium is supported on the medium support unit because the user is around the apparatus, an ejecting operation is executed regardless of a detection result of the detecting unit. In this manner, it is possible to suppress a decrease in throughput of the liquid droplet ejecting apparatus.

Meanwhile, when an ejecting instruction is given thorough a terminal, outputting of the second signal by the signal output unit is limited. That is, when it is not possible for a user to recognize that a medium is supported on the medium support unit since there is a possibility that the user may not exist around the apparatus, it is possible to limit executing of an ejecting operation.

In the liquid droplet ejecting apparatus, it is preferable that the detector radiates light toward a detecting target, detects the light intensity of reflected light from the detecting target, and outputs the first signal or the second signal corresponding to the light intensity of the reflected light.

According to the configuration, the controller allows or limits executing of an ejecting operation based on the first signal or the second signal corresponding to the light intensity of reflected light. For this reason, the first controller may simply determine whether to allow or limit executing of an ejecting operation according to a degree of intensity of light. Meanwhile, it is possible to simplify a signal which is output from the second controller.

In the liquid droplet ejecting apparatus, it is preferable that the second controller limits outputting the second signal when the difference in reflectivity is large and allows outputting the second signal when the difference in reflectivity is small, and an absolute value of the difference between the reflectivity of the medium and the reflectivity of the support face is set to the difference in reflectivity.

According to the configuration, when the difference in reflectivity between the medium and the support face is large, for example, when a white medium is supported on a black support face, or the like, the difference in light intensity of reflected light easily occurs between a case in which a medium is set to a detecting target and a case in which the support face is set to a detecting target, and there is no possibility that the detector erroneously outputs the first signal when the detector should output the second signal. On the other hand, when the difference in reflectivity between the medium and the support face is small, for example, when a black medium is supported on a black support face, or the like, the difference in light intensity of reflected light rarely occurs between a case in which the medium is set to the detecting target and a case in which the medium support unit is set to the detecting target, and there is a possibility that the detector erroneously outputs the first signal when the detector should output the second signal.

Therefore, in the above described configuration, it is set so that outputting of the second signal by the second controller is limited when the difference in reflectivity is large, and outputting of the second signal by the second controller is allowed when the difference in reflectivity is small. For this reason, when the difference in reflectivity is large, and the detector properly outputs the first signal, it is possible to suppress erroneous executing of an ejecting operation by causing the second controller to output the second signal. In addition, when the difference in reflectivity is small, and the detector erroneously outputs the first signal, it is possible to prevent executing of the ejecting operation from being limited by causing the second controller to output the second signal.

It is preferable that the controller includes a first controller and a second controller. The controller includes a first controller and a second controller. The detector is configured to output the first and second signals to the first controller. The first controller limits executing of the ejecting operation when the first signal is received and allowing executing of the ejecting operation when the second signal is received. The second controller is configured to output the second signal to the first controller under the specified condition.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which a liquid droplet ejecting apparatus is embodied in a printing apparatus will be described with reference to drawings. In addition, the printing apparatus according to the embodiment is an ink jet printer which forms characters or an image by ejecting ink as an example of liquid droplets onto the surface of cloth (such as T-shirt) as an example of a medium.

Figure 1:
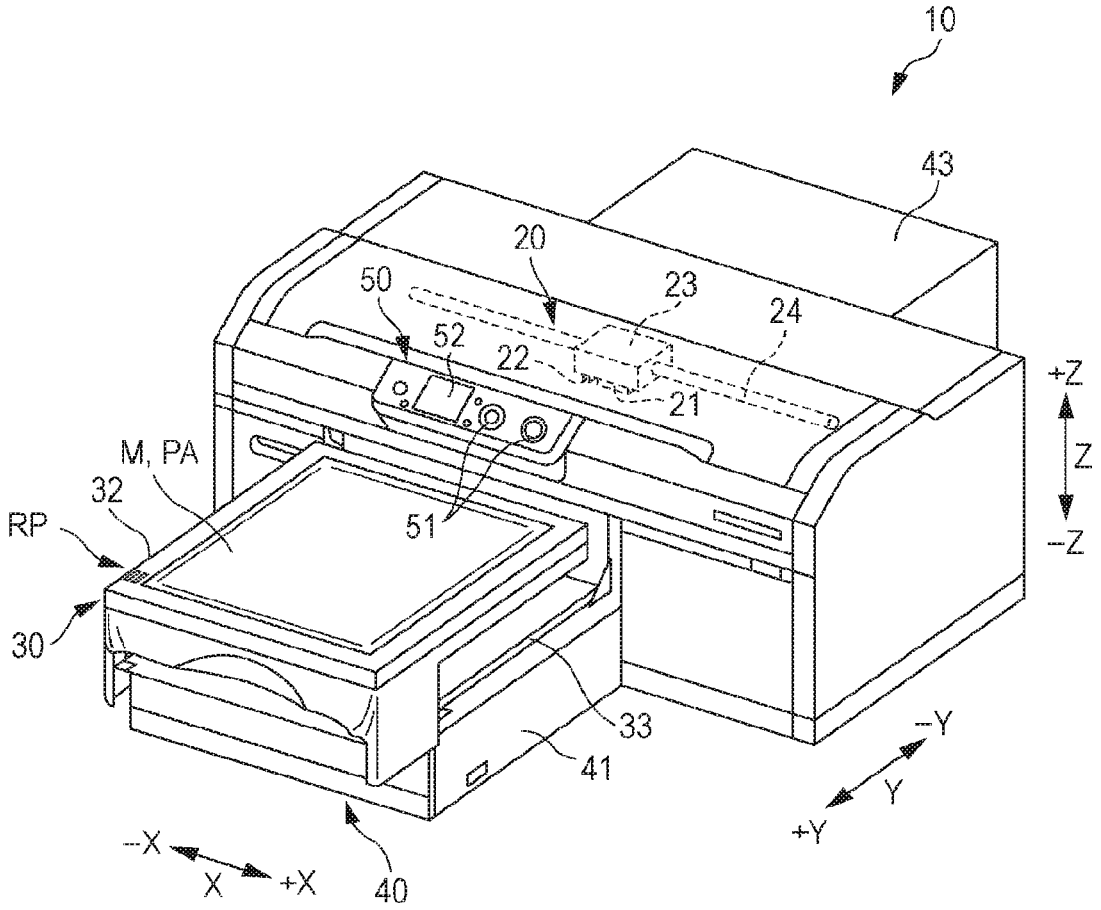
FIG. 1 is a perspective view of a printing apparatus.
Figure 2A:
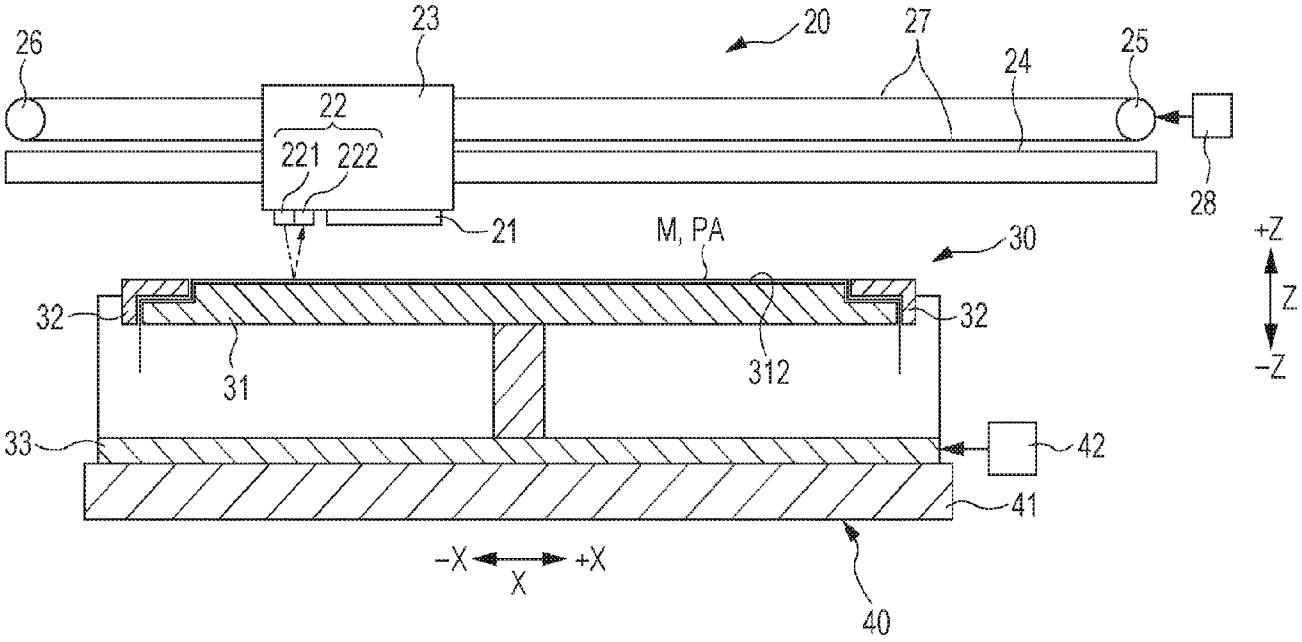
FIG. 2A is a front view which illustrates a partial configuration of the printing apparatus.
Figure 2B:
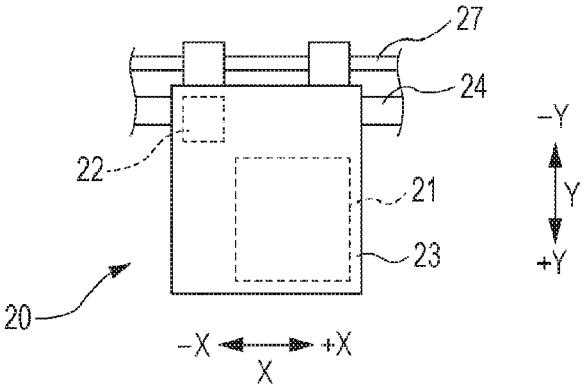
FIG. 2B is a plan view of a printing unit which is included in the printing apparatus.

As illustrated in FIGS. 1 to 2B, a printing apparatus 10 includes a printing unit 20 which performs printing on a medium M such as a T-shirt, a medium support unit 30 which supports the medium M, a transport unit 40 which transports the medium support unit 30, and a setting unit 50 in which various setting of the printing apparatus 10 is performed.

In addition, in the following descriptions, a width direction of the printing apparatus 10 is set to a width direction X (+X, −X), an anteroposterior direction of the printing apparatus 10 is set to a transport direction Y (+Y, −Y), and a vertical direction of the printing apparatus 10 is set to a vertical direction Z (+Z, −Z). Here, the width direction X, the transport direction Y, and the vertical direction Z are directions which are orthogonal to each other.

As illustrated in FIG. 2A, the printing unit 20 includes a liquid droplet ejecting unit 21 which ejects liquid droplets (ink), an optical detecting unit 22 which includes a light emitting unit 221 and a light receiving unit 222, a carriage 23 which supports the liquid droplet ejecting unit 21 and the detecting unit 22, and a guide shaft 24 which supports the carriage 23 so as to reciprocate in the width direction X.

In addition, the printing unit 20 includes a driving pulley 25 which is provided at one end in the width direction X, a driven pulley 26 which is provided on the other end in the width direction X, a timing belt 27 which is stretched to the driving pulley 25 and the driven pulley 26, and a carriage motor 28 which drives the driving pulley 25.

In the liquid droplet ejecting unit 21, nozzles (not illustrated) which are open so as to face the medium support unit 30 are formed. In addition, as illustrated in FIG. 2B, the liquid droplet ejecting unit 21 is arranged so as to be located on the transport direction +Y side compared to the detecting unit 22. In addition, the printing unit 20 performs printing on a medium M by causing the liquid droplet ejecting unit 21 to eject liquid droplets onto a printing region PA (ejecting region) of the medium M which is supported by the medium support unit 30.

The light emitting unit 221 of the detecting unit 22 radiates diffused light (projects light) toward the medium support unit 30, or the medium M which is supported by the medium support unit 30 as denoted by a one-dot chain line in FIG. 2A. In addition, as denoted by a two-dot chain line in FIG. 2A, the light receiving unit 222 of the detecting unit 22 receives reflected light of the diffused light which is radiated by the light emitting unit 221, and detects light intensity (intensity of received light) of the reflected light. That is, the detecting unit 22 according to the embodiment is a diffuse-reflective optical sensor which radiates diffused light toward a detecting target, and receives reflected light thereof.

In addition, as illustrated in FIGS. 2A and 2B, the driving pulley 25, the driven pulley 26, the timing belt 27, and the carriage motor 28 are provided on the rear face side (transport direction −Y side) of the carriage 23. The timing belt 27 is connected to the rear portion of the carriage 23.

In this manner, the timing belt 27 which is hanging on the driving pulley 25 and the driven pulley 26 rotates when the carriage motor 28 rotates, and the carriage 23 which is connected to the timing belt 27 moves in the width direction X which is a longitudinal direction of the guide shaft 24. Here, the carriage 23 moves in the width direction +X, or in the width direction −X according to a rotation direction of the carriage motor 28.

As illustrated in FIGS. 2A and 2B, and FIGS. 3A to 3C, the medium support unit 30 includes a mounting table 31 on which the medium M is mounted, a frame body 32 which is mounted on the mounting table 31 so that the medium M is pressed onto the mounting table 31, and a support table 33 which supports the mounting table 31 from a vertically lower part.

Figure 3A:
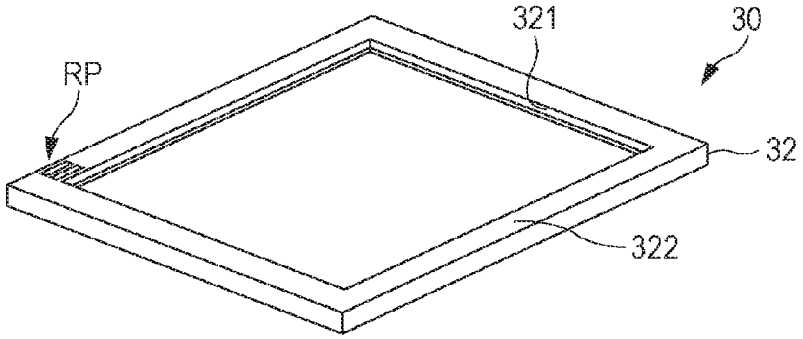
FIGS. 3A to 3C are exploded perspective views of a medium support unit which is included in the printing apparatus.
Figure 3B:
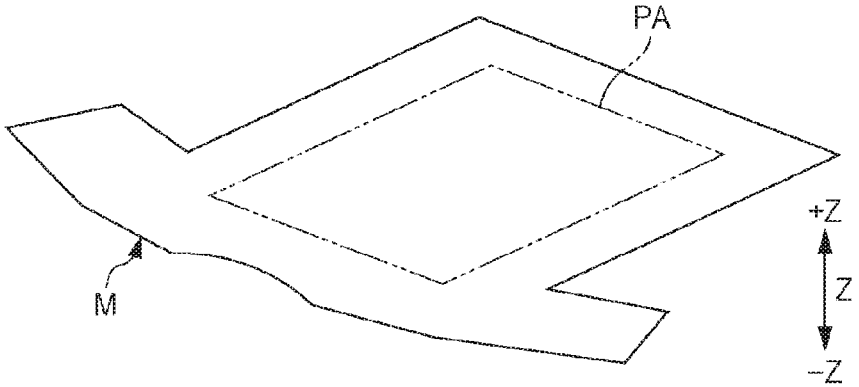
Figure 3C:
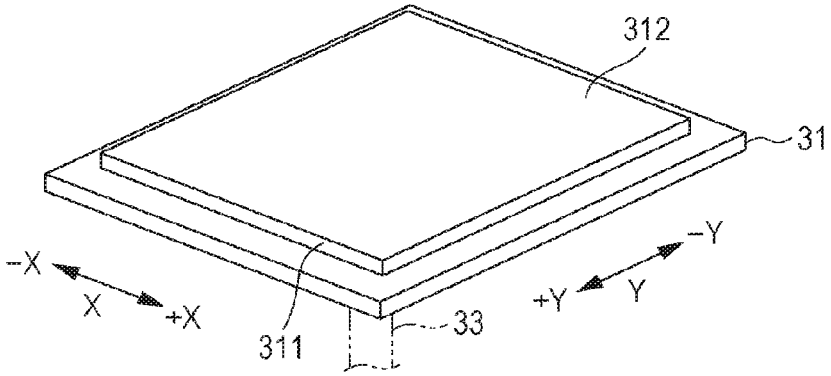

As illustrated in FIG. 3C, the mounting table 31 is formed in an approximately rectangular plate shape in which the transport direction Y is a longitudinal direction, and the width direction X is a transverse direction. In the mounting table 31, a protrusion portion 311 which is slightly smaller than an appearance in a planar view of the mounting table 31 is formed in a protruding manner toward a side opposite to the support table 33 (vertically higher part). In the mounting table 31, a support face 312 which supports the medium M by facing the liquid droplet ejecting unit 21 and the detecting unit 22 which are supported by the carriage 23 is formed.

As illustrated in FIG. 3A, the frame body 32 has approximately the same shape as that of the mounting table 31 in a planar view. In addition, the frame body 32 is engaged with the protrusion portion 311 of the mounting table 31 when being mounted on the mounting table 31, and is formed with an opening portion 321 for exposing the printing region PA of the medium M. In the frame body 32, a face which faces the liquid droplet ejecting unit 21 and the detecting unit 22 which are supported by the carriage 23 is referred to as a front surface 322.

Figure 4:
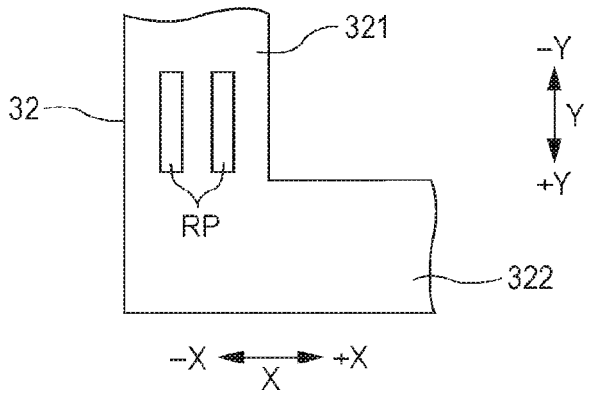
FIG. 4 is an enlarged plan view which illustrates one corner (near corner on left side) of a frame body of the medium support unit.

As illustrated in FIG. 4, on the front surface 322 of the frame body 32, a plurality of (two) reflection patterns RP with higher reflectivity than that of the front surface 322 of the frame body 32 are formed with an interval in the width direction X. Here, the reflection pattern RP is formed at a portion which is an end portion (left end portion) on the width direction −X side, and is an end portion in the transport direction +Y side (front end portion) of the frame body 32. In addition, the reflection pattern RP may be directly formed on the front surface 322 of the frame body 32, and may be formed by bonding a film on which the reflection pattern RP is formed to the front surface 322 of the frame body 32. In addition, FIG. 4 is an enlarged plan view of a front corner portion on the left side of the frame body 32.

In addition, the reflectivity of the front surface 322 of the frame body 32 and the reflectivity of the reflection pattern RP of the frame body 32 may have a difference in which it is possible to discriminate the light intensity of reflected light when the front surface 322 is set to a detecting target by the detecting unit 22 from the light intensity of reflected light when the reflection pattern RP is set to a detecting target by the detecting unit. For example, the front surface 322 of the frame body 32 may be set to a black surface which is colored in black, a diffusible reflecting surface which reflects radiated light in a diffusible manner, and an inclined reflecting surface which reflects radiated light at a position deviated from the light receiving unit 222 of the detecting unit 22. In addition, the reflection pattern RP may be set to a white surface which is colored in white, and a specular surface which performs a mirror-reflection with respect to radiated light.

In this manner, the frame body 32 is mounted on the mounting table 31 so as to hem the medium M (printing region PA). In addition, in the following descriptions, a state in which the medium M is interposed between the mounting table 31 and the frame body 32 of the medium support unit 30 will be referred to as a state in which the medium M is supported by the medium support unit 30.

According to the embodiment, the front surface 311 of the mounting table 31 and the front surface 322 of the frame body 32 are set to the same color (for example, black). For this reason, the front surface 311 of the mounting table 31 and the front surface 322 of the frame body 32 have the same reflectivity.

As illustrated in FIGS. 1 and 2A, the transport unit 40 includes a base portion 41 which movably supports the medium support unit 30 (support table 33) in the transport direction Y, a transport motor 42 which can move the medium support unit 30 in the transport direction Y with respect to the base portion 41, and a case 43 which covers the rear portion of the base portion 41.

As illustrated in FIG. 1, the base portion 41 is formed so as to protrude frontward or backward from the front face and rear face of the printing apparatus 10. Here, when the medium support unit 30 is supported on the front part of the base portion 41, the medium support unit 30 is exposed.

For this reason, in this case, it is possible for a user to set the medium M in the medium support unit 30, or remove the medium M from the medium support unit 30. In this point, as illustrated in FIG. 1, a position at which the medium support unit 30 is supported on the front part of the base portion 41 is also referred to as a "setting position". Meanwhile, when the medium support unit 30 is supported on the rear part of the base portion 41, the medium support unit 30 is covered by the case 43.

In addition, as a mechanism for moving the medium support unit 30 (support table 33) in the transport direction Y, a mechanism which converts the rotational movement of the transport motor 42 into linear movement of the medium support unit 30 (support table 33) may be used. For example, a mechanism using a pulley and a belt may be used, or a mechanism using a rack and a pinion may be used. In addition, the transport unit 40 drives the transport motor 42, and moves (transports) the medium support unit 30 (support table 33) in the transport direction Y. Here, a direction in which the medium support unit 30 is transported is a direction which varies according to the rotational movement of the transport motor 42.

In addition, since the printing apparatus 10 according to the embodiment is a so-called serial printer, when printing the medium M, a transport operation of the medium support unit 30 (medium M) toward the transport direction −Y side, movement operations of the carriage 23 in the width direction +X and the width direction −X are alternately performed. In the following descriptions, when performing printing, a transport amount in the transport operation of the medium support unit 30 which is alternately performed together with the movement operation of the carriage 23 is also referred to as a "unit transport amount". The unit transport amount is set according to the length of a nozzle column which is formed in the liquid droplet ejecting unit 21.

In the printing apparatus 10 according to the embodiment, when printing is started after setting a medium M in the medium support unit 30 at a setting position, first, the medium support unit 30 is moved in the transport direction −Y so that the medium support unit is supported on the rear part of the base portion 41. Thereafter, the printing unit 20 performs printing on the medium M which is supported by the medium support unit 30 while moving the medium support unit 30 in the transport direction +Y.

As illustrated in FIG. 1, the setting unit 50 is provided at a higher part on the front face of the printing apparatus 10. In addition, the setting unit 50 includes an operation unit 51 which is operated when performing various setting of the printing apparatus 10, or making a printing instruction, and a display unit 52 which displays various information of the printing apparatus 10. The operation unit 51 is configured of a plurality of buttons. In addition, the display unit 52 may be configured of a liquid crystal display, or the like, for example. In the following descriptions, a printing instruction (ejecting instruction) with respect to the printing apparatus 10 through the operation unit 51 is also referred to as a "direct instruction".

Subsequently, an electrical configuration of the printing apparatus 10 according to the embodiment will be described with reference to FIG. 5.

Figure 5:
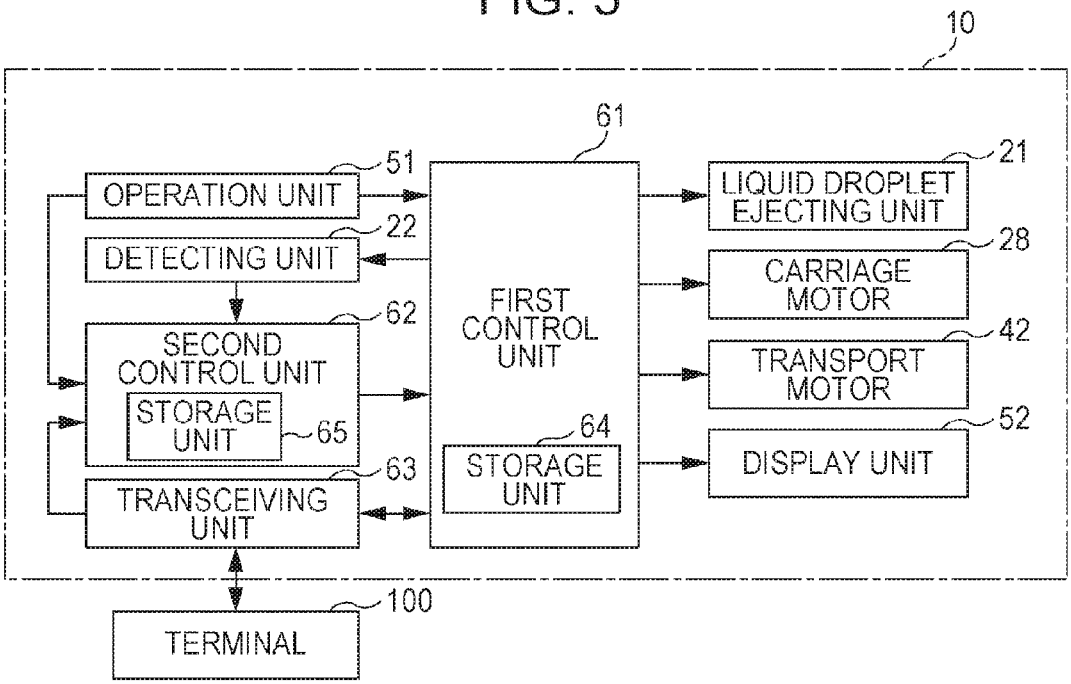
FIG. 5 is a block diagram which illustrates an electrical configuration of the printing apparatus.

As illustrated in FIG. 5, the printing apparatus 10 includes a first control unit 61 (main control unit) which integrally controls the apparatus, a second control unit 62 which outputs a signal to the first control unit 61, and a transceiving unit 63 which functions as an interface when transmitting and receiving information between the unit and a terminal 100.

The first control unit 61 and the second control unit 62 includes storage units 64 and 65 which are formed of a non-volatile memory. In the storage units 64 and 65, various information of the printing apparatus 10 such as control variables which are used when control each configuration of the printing apparatus 10, or the like, are stored.

The transceiving unit 63 performs transceiving of information to and from the terminal 100 when the printing apparatus 10 transmits information to the terminal 100, or receives information from the terminal 100. In this point, according to the embodiment, the transceiving unit 63 corresponds to an example of a "receiving unit".

The terminal 100 is, for example, a personal computer or a smart phone, and is connected to the transceiving unit 63 in a wired or wireless manner. That is, there also is a case in which the terminal 100 is provided at a remote place from the printing apparatus 10, and performs various setting of the printing apparatus 10, or gives a printing instruction to the printing apparatus from the remote place. In the following descriptions, a printing instruction (ejecting instruction) which is given to the printing apparatus 10 using the terminal 100 is also referred to as an "indirect instruction".

In addition, the operation unit 51, the second control unit 62, and the transceiving unit 63 are connected to an input side interface of the first control unit 61, and the liquid droplet ejecting unit 21, the detecting unit 22, the carriage motor 28, the transport motor 42, the display unit 52, and the transceiving unit 63 are connected to an output side interface of the first control unit 61. In this manner, the first control unit 61 determines whether or not to cause the liquid droplet ejecting unit 21 to eject liquid droplets based on a signal which is output from the second control unit 62, for example.

In addition, the detecting unit 22, the operation unit 51, and the transceiving unit 63 are connected to the input side interface of the second control unit 62, and the first control unit 61 is connected to the output side interface of the second control unit 62. That is, according to the embodiment, a signal which is output from the detecting unit 22 is not directly input to the first control unit 61, and is input to the first control unit 61 through the second control unit 62.

In this manner, the second control unit 62 outputs a signal which is input from the detecting unit 22 to the first control unit 61 as is, based on information which is stored in the storage unit 65 of the second control unit 62, or information which is output from the operation unit 51 and the transceiving unit 63, or outputs a signal which is different from the signal which is input from the detecting unit 22 to the first control unit 61.

In addition, in the following descriptions, when the liquid droplet ejecting unit 21 is caused to eject liquid droplets toward the medium M while moving the carriage 23 in the width direction +X or the width direction −X by driving the carriage motor 28 by driving the carriage motor 28, it is also referred to as a "printing operation (ejecting operation)". In addition, when light is radiated to the medium support unit 30, or the medium M which is supported by the medium support unit 30, and the light intensity of reflected light thereof is detected while moving the carriage 23 in the width direction +X or the width direction −X, it is also referred to as a "detecting operation". In addition, a signal which is output from the detecting unit 22 is also referred to as a "detecting signal", and a signal which is output from the second control unit 62 is also referred to as an "output signal". Here, the output signal of the second control unit 62 can also be referred to as a dummy signal of the detecting signal of the detecting unit 22.

Subsequently, the detecting operation using the detecting unit 22, and a method of determining whether or not a medium M is supported by the medium support unit 30 using the first control unit 61 will be described in detail with reference to FIGS. 6A and 6B.

Figure 6A:
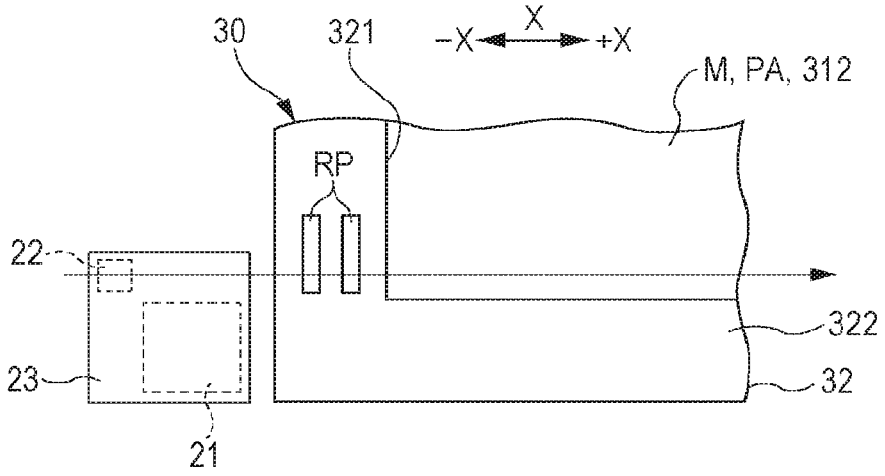
FIG. 6A is a plan view which illustrates a state in which a carriage goes across the medium support unit in a detecting operation.

As illustrated in FIG. 6A, in the detecting operation, the carriage 23 is moved toward the width direction +X so as to intersect the medium support unit 30 in a state in which the detecting unit 22 and the medium M which is supported by the medium support unit 30 are arranged so as to overlap each other, in the transport direction Y. In addition, along with the movement of the carriage 23, light is radiated to the medium M or the medium support unit 30 from the detecting unit 22, and reflected light of the light is received.

Figure 6B:
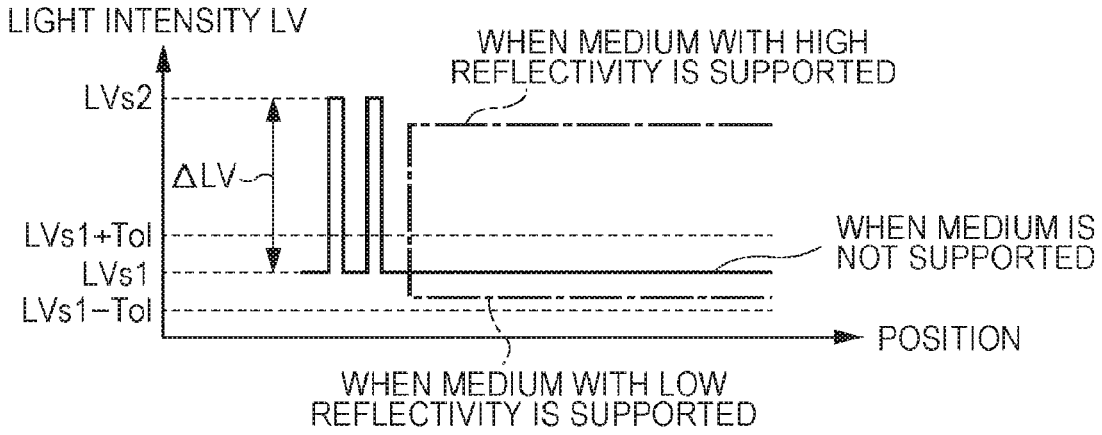
FIG. 6B is a graph which denotes a light intensity distribution when conditions of the medium support unit for supporting a medium are different.

Then, as illustrated in FIG. 6B, light intensity distribution with respect to a position in the width direction X is obtained. Here, in FIG. 6B, the light intensity distribution in a state in which a medium M is not supported on the medium support unit 30 is denoted by a solid line, and an example of the light intensity distribution when a medium M is supported on the medium support unit 30 is denoted by a one-dot chain line, and a two-dot chain line.

Specifically, in FIG. 6B, a case in which a medium M with higher reflectivity than that of the support face 312 of the mounting table 31 (hereinafter, also referred to as "medium with high reflectivity") is supported on the support face 312 is denoted by a one-dot chain line, and a case in which a medium M with lower reflectivity than that of the support face 312 of the mounting table 31 (hereinafter, also referred to as "medium with low reflectivity") is supported on the support face 312 is denoted by a two-dot chain line. In addition, in FIG. 6B, since a light intensity distribution when the detecting unit 22 intersects the frame body 32 thereon in the width direction +X is the same, regardless of the fact whether or not a medium M is supported on the support face 312, the light intensity distribution is described by overlapping a solid line, a one-dot chain line, and a two-dot chain line.

As denoted using a solid line, a one-dot chain line, and a two-dot chain line in FIG. 6B, in a region in which the reflection pattern RP of the frame body 32 is formed (left end portion of frame body 32), since reflectivity of the reflection pattern RP is larger than that of the front surface 322 of the frame body 32, a light intensity LV (intensity of received light of the detecting unit 22) in the width direction X increases or decreases. Here, an absolute value of a difference between a light intensity LV when the front surface 322 is set to a detecting target (first reference light intensity LVs1) and a light intensity LV when the reflection pattern RP is set to a detecting target (second reference light intensity LVs2) is set to a light intensity difference ΔLV. The light intensity difference ΔLV is used when performing a correction in the detecting unit 22, as will be described later.

In addition, as denoted by the solid line in FIG. 6B, when a medium M is not supported on the medium support unit 30, since reflectivity of the front surface 322 of the frame body 32 and reflectivity of the support face 312 of the mounting table 31 are the same as each other, a light intensity LV at a position corresponding to the support face 312 becomes the first reference light intensity LVs1.

Meanwhile, as denoted by the one-dot chain line in FIG. 6B, when a medium M with high reflectivity is supported on the medium support unit 30, since reflectivity of the medium M becomes higher than that of the support face 312 of the mounting table 31, a light intensity LV at a position corresponding to the medium M which is supported on the support face 312 becomes larger than the first reference light intensity LVs1 in the width direction X.

In addition, as denoted by the two-dot chain line in FIG. 6B, when a medium M with low reflectivity is supported on the medium support unit 30, since reflectivity of the medium M becomes lower than that of the support face 312 of the mounting table 31, a light intensity LV at a position corresponding to the medium M which is supported on the support face 312 becomes smaller than the first reference light intensity LVs1 in the width direction X.

Accordingly, in a case in which it is not clear whether or not a medium M is supported on the support face, when a light intensity LV of reflected light at a time of setting a position corresponding to the support face 312 (region in the inside of opening portion 321 of frame body 32) to a detecting target is the same as the first reference light intensity LVs1, it is determined that a medium M is not supported on the support face 312. Meanwhile, in the same case, when a light intensity LV of reflected light at a time of setting a position corresponding to the support face 312 to a detecting target is different from the first reference light intensity LVs1, it is determined that a medium M is supported on the support face 312.

In addition, in practice, since there is a case in which an error is included in a detection result of the detecting unit 22 depending on a detection accuracy or measuring conditions of the detecting unit 22, it is preferable to consider a "tolerance Tol" based on an influence of the error. That is, when an absolute value of a difference between a light intensity LV of reflected light when a position corresponding to the support face 312 is set to a detecting target and the first reference light intensity LVs1 is the tolerance Tol or more, a determination that a medium M is supported on the support face 312 may be made.

In addition, when an absolute value of a difference between a light intensity LV of reflected light when a position corresponding to the support face 312 is set to a detecting target and the first reference light intensity LVs1 is less than the tolerance Tol, a determination that a medium M is not supported on the support face 312 may be made. In addition, it is preferable to set the tolerance Tol based on an experiment in advance, or the like, using a variation in reflectivity on the support face 312, a detection accuracy of the detecting unit 22, or the like.

In addition, in the following descriptions, as denoted by the solid line and the two-dot chain line in FIG. 6B, when a light intensity LV at a position corresponding to the support face 312 is less than a light intensity LV which is obtained by adding a tolerance Tol to the first reference light intensity LVs1, and is a light intensity LV or more which is obtained by subtracting a tolerance Tol from the first reference light intensity LVs1, a signal which is output from the detecting unit 22 is also referred to as a "first signal". That is, the first signal is a signal which is output from the detecting unit 22 when a light intensity LV at a position corresponding to the support face 312 satisfies a relationship of "(LVs1−Tol)≤LV<(LVs1+Tol)". In addition, the first signal is a signal for the first control unit 61 to determine that a medium M is not supported on the medium support unit 30, when being input to the first control unit 61.

In addition, as denoted by the one-dot chain line in FIG. 6B, in a case in which a light intensity LV at a position corresponding to the support face 312 is the light intensity LV or more which is obtained by adding a tolerance Tol to the first reference light intensity LVs1, and a case in which the light intensity LV is less than the light intensity which is obtained by subtracting the tolerance Tol from the first reference light intensity LVs1, a signal which is output from the detecting unit 22 is also referred to as a "second signal". That is, the second signal is a signal which is output from the detecting unit 22 when the light intensity LV at the position corresponding to the support face 312 satisfies a relationship of "LV<(LVs1−Tol)", and a relationship of "(LVs1+Tol)≤LV", and is different from the first signal. In addition, the second signal is a signal for the first control unit 61 to determine that a medium M is supported on the medium support unit 30, when being input to the first control unit 61.

Subsequently, an influence of reflectivity of a medium M on determining whether or not a medium M is supported on the medium support unit 30, as described above, will be described.

When reflectivity of a medium M is sufficiently higher than that of the support face 312 as denoted by the one-dot chain line in FIG. 6B, since a difference of an absolute value between a light intensity LV when a medium M which is supported on the support face 312 is set to a detecting target and the first reference light intensity LVs1 is the tolerance Tol or more, a detection signal which is output from the detecting unit 22 becomes the second signal. For this reason, it is properly determined that a medium M is supported on the support face 312.

Meanwhile, as denoted by the two-dot chain line in FIG. 6B, since a difference of an absolute value between a light intensity when a medium M which is supported on the support face 312 is set to a detecting target and the first reference light intensity LVs1 is less than the tolerance Tol when reflectivity of the medium M is approximately the same as that of the support face 312, a detection signal which is output from the detecting unit 22 becomes the first signal. For this reason, it is erroneously determined that a medium M is not supported on the support face 312.

That is, when the difference of the absolute value between a light intensity LV when a medium M which is supported on the support face 312 is set to a detecting target and the first reference light intensity LVs1 is less than the tolerance Tol, even when a medium M is supported on the support face 312, the first signal is output from the detecting unit 22, it is erroneously determined that a medium M is not supported on the support face 312.

Therefore, according to the embodiment, it is set so that determination on propriety of printing is made as follows, in order to prevent executing of a printing operation from being limited even when a medium M is supported on the support face 312, due to outputting of the first signal.

That is, it is set so that executing of a printing operation is allowed even when a detection signal from the detecting unit 22 is the first signal (even when the above described absolute value of difference is less than tolerance Tol), in a case in which it is possible to recognize that a medium M is supported on the medium support unit 30, by visually checking the medium support unit 30 by a user, for example, in a case in which the user is around the printing apparatus 10, or the like.

Therefore, it is set so that a time zone in which a user is around the printing apparatus 10 in order to use the printing apparatus 10 is stored in the second control unit 62 in advance, as an "allowed time zone Ta". In addition, it is set so that the second control unit 62 outputs the second signal when a timing in which a detection signal (first signal or second signal) is output from the detecting unit 22 is in the allowed time zone Ta which is stored in the storage unit 65, even when the detection signal is the first signal (even when the above described absolute value of difference is less than tolerance Tol).

In addition, it is set so that the second control unit 62 does not output the second signal when a detection signal is the first signal (when the above described absolute value of difference is less than tolerance Tol), in a case in which a timing in which a detection signal (first signal or second signal) is output from the detecting unit 22 is out of the allowed time zone Ta which is stored in the storage unit 65. That is, it is set so that the first signal is output. In addition, the allowed time zone Ta which is stored in the storage unit 65 of the second control unit 62 is for example, information such as time from nine o'clock a.m. to five o'clock p.m.

In addition, when a printing instruction from a user is a direction instruction, it is considered that a user is around the printing apparatus 10, since the user operates the printing apparatus 10 through the operation unit 51. Therefore, it is set so that the second control unit 62 outputs the second signal when a printing instruction is a direct instruction which is given through the operation unit 51, even when a detection signal is the first signal (even when the above described absolute value of difference is less than tolerance Tol).

In addition, when a printing instruction from a user is an indirect instruction, since the use is operating the printing apparatus 10 through the terminal 100, it may be difficult to conclude that the user is around the printing apparatus 10. Therefore, it is set so that the second control unit 62 does not output the second signal when a detection signal is the first signal (when the above described absolute value of difference is less than tolerance Tol), in a case in which the printing instruction is an indirect instruction which is given through the terminal 100. That is, it is set so that the first signal is output.

In addition, it is preferable that the second signal which is output from the second control unit 62 is stored in the storage unit 65 of the second control unit 62 in advance. Meanwhile, as the first signal which is output from the second control unit 62, the first signal which is output from the detecting unit 22 may be used, or a signal which is stored in the storage unit 65 of the second control unit 62 in advance may be used.

Figure 7:
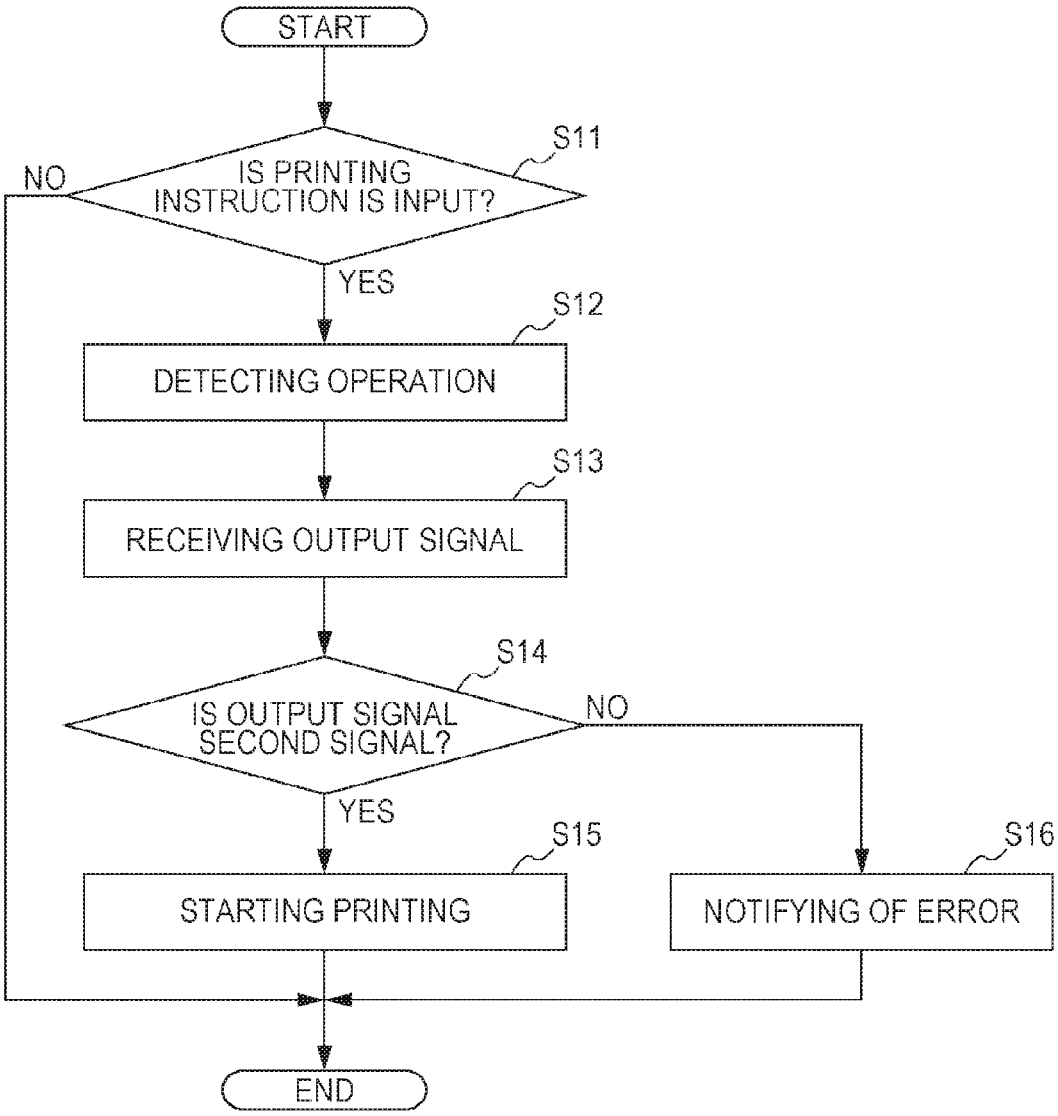
FIG. 7 is a flowchart which illustrates a processing routine executed by a first control unit which is performed when performing printing on a medium.

Subsequently, a process routine which is performed by the first control unit 61 when the printing apparatus 10 starts printing will be described with reference to the flowchart which is illustrated in FIG. 7.

As illustrated in FIG. 7, the first control unit 61 determines whether or not a printing instruction is input to the first control unit 61 from the operation unit 51 which is provided in the printing apparatus 10, or the terminal 100 which is connected to the printing apparatus 10 (step S11). When a printing instruction is not input (No in step S11), the first control unit 61 temporarily ends the process. Meanwhile, when a printing instruction is input (Yes in step S11), the first control unit 61 causes a detecting operation to be executed (step S12). That is, the first control unit 61 controls the carriage motor 28 and the detecting unit 22, causes the detecting unit 22 to radiate light toward a medium M, and to detect a light intensity of reflected light of the light, while moving the carriage 23 in the width direction +X, and in the width direction −X.

In addition, when a detecting operation in step S12 is executed, the medium support unit 30 is transported in the transport direction −Y before executing the detecting operation so that the detecting unit 22 which is supported by the carriage 23 and the support face 312 of the medium support unit 30 overlap with each other in the transport direction Y. In addition, a detection signal which is output from the detecting unit 22, when executing the detecting operation, is output to the second control unit 62 in a process routine (which will be described later) executed by the second control unit 62.

In addition, in the detecting operation, a correction in the detecting unit 22 is performed based on a difference in light intensity ΔLV which is an absolute value of a difference between the first reference light intensity LVs1 when the front surface 322 of the frame body 32 is set to a detecting target and the second reference light intensity LVs2 when the reflection pattern RP is set to a detecting target.

For example, when a difference in light intensity ΔLV when using the printing apparatus 10 is smaller than a difference in light intensity ΔLV at a time of shipping of the printing apparatus 10, performing of a correction is taken into consideration by increasing an output of the light emitting unit 221 by assuming that the output of the light emitting unit 221 of the detecting unit 22 is decreased.

As an example, it is assumed that the first reference light intensity LVs1 is "5", the second reference light intensity LVs2 is "10" in a detecting operation at a time of shipping, and an output of the light emitting unit 221 when using the printing apparatus 10 is decreased by "20%". Then, the first reference light intensity LVs1 in the detecting operation when using the printing apparatus 10 becomes "4", the second reference light intensity LVs2 becomes "8", and the difference in light intensity ΔLV is reduced to "4" from "5". Accordingly, when the difference in light intensity ΔLV is reduced, it is preferable to increase an output of the light emitting unit 221 of the detecting unit 22 according to a decrease rate of the difference in light intensity ΔLV. In addition, when increasing an output of the light emitting unit 221 in the middle of detecting operation, it is preferable to increase the output until the detecting unit 22 moves to a position corresponding to the support face 312 in the width direction X.

Incidentally, when ambient light which is input to the light receiving unit 222 of the detecting unit 22 is reduced, since intensities of both the first reference light intensity LVs1 and the second reference light intensity LVs2 are reduced by the same light intensity, the difference in light intensity ΔLV is rarely changed. Accordingly, when the difference in light intensity ΔLV is reduced, it is considered that a decrease in output of the light emitting unit 221 of the detecting unit 22 is one of reasons.

In this manner, a variation in detecting result of the detecting unit 22 is suppressed by performing a correction in the detecting unit 22 according to a change in the difference in light intensity ΔLV. In addition, when the difference in light intensity ΔLV is a value difficult to be used in a correction, for example, when the value is extremely large or small, the first control unit 61 may inform a user of the printing apparatus a possibility of a failure of the detecting unit 22.

Subsequently, the first control unit 61 receives a signal which is output from the second control unit 62 in steps S24 and S27 which will be described later (step S13), and determined whether or not the output signal is the second signal (step S14). When the output signal is the second signal (Yes in step S14), the first control unit 61 causes printing onto the medium M to be started (step S15). That is, the first control unit 61 causes a printing operation to be performed by controlling the carriage motor 28 and the liquid droplet ejecting unit 21, and causes a transport operation to be performed by controlling the transport motor 42. Thereafter, when printing onto the medium M is finished, the first control unit 61 temporarily ends the process.

On the other hand, when the output signal is the first signal in the previous step S14 (No in step S14), the first control unit 61 causes the error to be informed (step S16). That is, when the output signal is the first signal, since it is determined that a medium M is not supported on the medium support unit 30, the fact is informed. As an informing method of an error, a message may be displayed on the display unit 52, or an error sound may be made. Thereafter, the first control unit 61 temporarily ends the process.

In this manner, the first control unit 61 limits a printing operation (ejecting operation) when the first signal is input (No in step S14, step S16), and allows executing of a printing operation (ejecting operation) when the second signal is input (Yes in step S14, step S15).

Subsequently, a process routine which is performed by the second control unit 62 when the printing apparatus 10 start printing will be described with reference to the flowchart illustrated in FIG. 8. The process routine is performed every time the process in step S12 of the first control unit 61 is executed.

Figure 8:
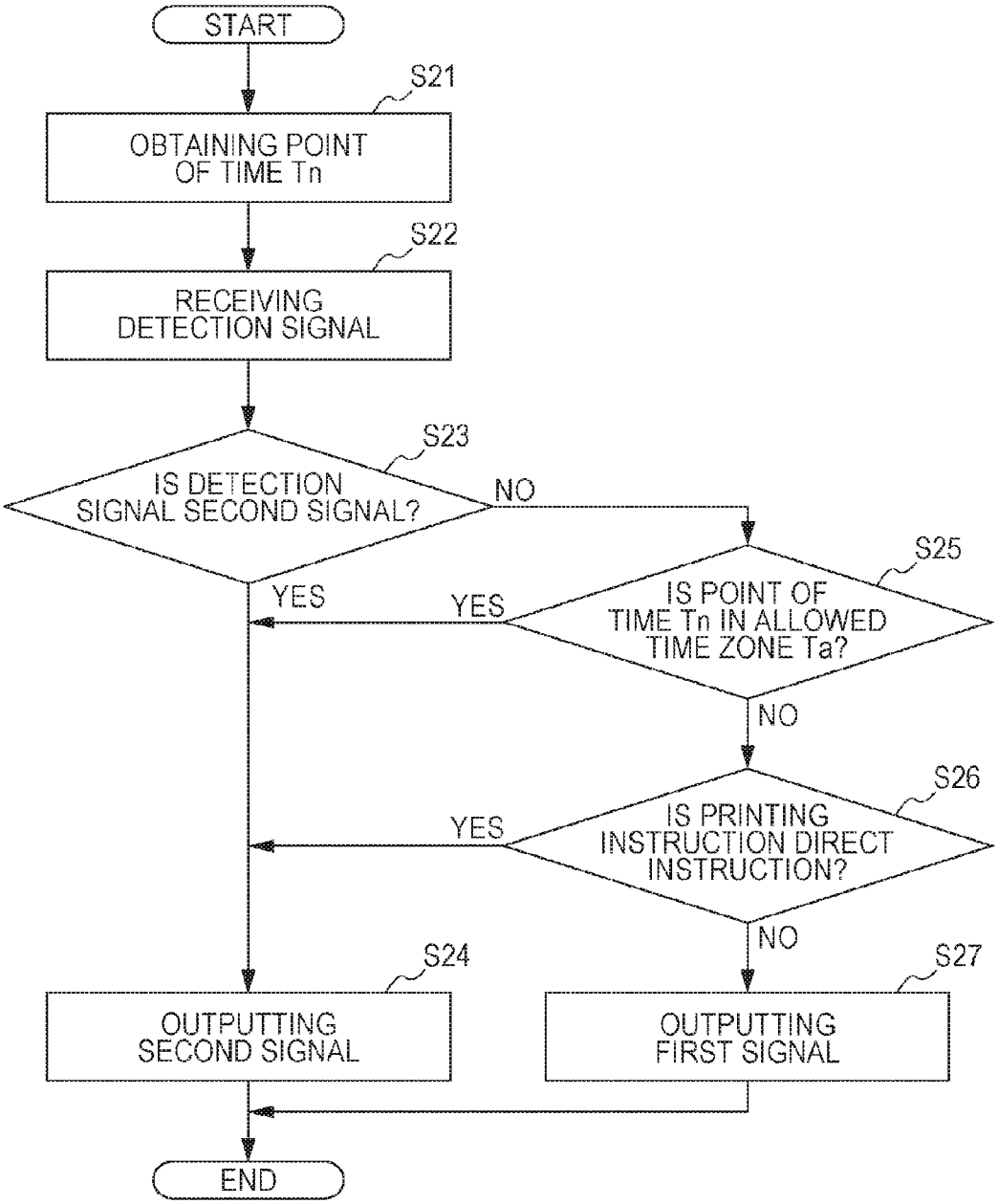
FIG. 8 is a flowchart which illustrates a processing routine executed by a second control unit which is performed when performing printing on a medium.

As illustrated in FIG. 8, the second control unit 62 obtains a point of time Tn at a time in which the process routine is started (step S21), and obtains a detection signal (first signal or second signal) which is output from the detecting unit 22 in the detecting operation in step S12 (step S22).

In addition, the second control unit 62 determines whether or not the received detection signal is the second signal (step S23). When the detection signal is the second signal (Yes in step S23), the second control unit 62 outputs the second signal to the first control unit 61 (step S24), and temporarily ends the process thereafter. In addition, the case in which the detection signal is the second signal is a case in which it is possible to determine that a medium M is supported on the medium support unit 30, according to a detection result of the detecting unit 22.

On the other hand, when the detection signal is not the second signal (No in step S23), the second control unit 62 determines whether or not the point of time Tn which is obtained in the previous step S21 is in the allowed time zone Ta (step S25). When the point of time Tn is included in the allowed time zone Ta (Yes in step S25), the second control unit 62 proceeds to step S24, and on the other hand, when the point of time Tn is not included in the allowed time zone Ta (No in step S25), the second control unit determines whether or not the printing instruction is a direct instruction which is given through the operation unit 51 (step S26).

When the printing instruction is a direction instruction (Yes in step S26), the second control unit 62 outputs the second signal, and on the other hand, when the printing instruction is not the direction instruction (No in step S26), the second control unit outputs the first signal (step S27). Thereafter, the second control unit 62 temporarily ends the process.

In this manner, in the second control unit 62, there is a case of outputting the first signal which is the same as the detection signal from the detecting unit 22 (Yes in step S23), and a case of outputting the second signal which is the same as the detection signal (second signal) from the detecting unit 22 (No in step S25, No in step S26). In addition, in the second control unit 62, there is a case in which the second signal which is different from the detection signal (first signal) is output from the detecting unit 22 (Yes in step S25, Yes in step S26). That is, since the second control unit 62 outputs the second signal to the first control unit 61, in the embodiment, the second control unit 62 also functions as a "signal output unit".

According to the embodiment, the detection signal of the detecting unit 22 is not output to the first control unit 61, and the second control unit 62 is caused to output the signal. In addition, in the second control unit 62, whether to output the detection signal to the first control unit 61 as is, or to output a signal which is different from the detection signal to the first control unit 61 is determined.

Subsequently, operations of the printing apparatus 10 according to the embodiment will be described.

When printing is performed on a medium M in the printing apparatus 10 according to the embodiment, the medium support unit 30 is moved to a setting position, and a user is caused to set the medium M. In addition, when there is a printing instruction from the user, as illustrated in FIG. 6A, the medium support unit 30 is transported in the transport direction −Y so that the support face 312 of the medium support unit 30 and the detecting unit 22 which is supported by the carriage 23 overlap with each other in the transport direction Y.

Subsequently, a detecting operation is performed by causing the detecting unit 22 to intersect the frame body 32 and the support face 312 along with a movement of the carriage 23 in the width direction X, and a light intensity distribution of reflected light in the width direction X is obtained.

Here, when an absolute value of a difference between reflectivity of the support face 312 and reflectivity of the medium M supported by the support face 312 is small, a difference in light intensity LV of reflected light between setting of the support face 312 to a detecting target and setting of the medium M to a detecting target becomes small. For this reason, there is a concern that it may be determined that the medium M is not supported on the support face 312, and executing of printing may be limited.

However, according to the embodiment, even in such a case, if the point of time Tn when there is a printing instruction is in the allowed time zone Ta which is set in the storage unit 65 of the second control unit 62 (Yes in step S25), executing of printing is allowed (Yes in step S14). That is, executing of printing is allowed by assuming that a user is around the printing apparatus 10, and the user can check whether or not the medium M is supported on the support face 312 (Yes in step S14).

In addition, even when the point of time Tn is out of the allowed time zone Ta (No in step S25), if a printing instruction from a user is given through the operation unit 51 of the printing apparatus 10 (Yes in step S26), executing of printing is allowed, similarly, since the user is around the printing apparatus 10 (Yes in step S14).

In this manner, according to the embodiment, it is possible to suppress a decrease in throughput related to printing which is caused when executing of printing is limited when it is determined that a medium M is not supported on the support face 312. In addition, the throughput here is the number of sheets of the medium M which can be printed by the printing apparatus 10 per unit time, a printing area, or the like.

According to the above described embodiment, it is possible to obtain the following effects.

(1) According to the embodiment, when the second signal is input to the first control unit 61 from the second control unit 62, it is possible to cause the printing apparatus 10 to perform regardless of a detection result of the detecting unit 22. For this reason, it is possible to avoid a situation in which executing of printing is limited when the detecting unit 22 outputs the first signal to the first control unit 61 even when a medium M is supported on the medium support unit 30. Therefore, according to the embodiment, it is possible to suppress a decrease in throughput in the printing apparatus 10.

(2) When a user can check that a medium M is supported on the medium support unit 30, for example, when the user is around the printing apparatus 10, or the like, it is possible to suppress ejecting of liquid droplets to the medium support unit 30 on which the medium M is not supported, even when a printing operation is executed regardless of a detection result of the detecting unit 22.

Therefore, according to the embodiment, it is possible to improve throughput of the printing apparatus 10 by causing printing to be performed when there is no problem in executing of printing, by setting the allowed time zone Ta which is stored in the storage unit 65 of the second control unit 62 to a time zone in which a user is around the printing apparatus 10.

(3) When a printing instruction is given through the operation unit 51 of the printing apparatus 10, it is set so that the second control unit 62 outputs the second signal, since it is considered that a user is around the printing apparatus 10. For this reason, since printing is executed regardless of a detection signal of the detecting unit 22, it is possible to increase throughput of the printing apparatus 10.

Meanwhile, when a printing instruction is given through the terminal 100, it is set so that the second control unit 62 is caused to output the first signal, since there is a concern that a user may not exist around the apparatus. For this reason, when it is considered that it is not possible for the user to recognize that a medium M is supported on the medium support unit 30, it is possible to suppress executing of printing, and to avoid a situation in which liquid droplets are ejected to the medium support unit 30 on which a medium M is not supported.

(4) A difference between the first signal and the second signal is only the fact that whether a difference between a light intensity LV at a portion corresponding to the support face 312 which supports the medium M and the first reference light intensity LVs1 is small or large. For this reason, it is easy for the second control unit 62 to generate the second signal which is output depending on a case. That is, it is possible to make a control configuration easy when the second control unit 62 outputs the first signal.

(5) When performing a detecting operation, since a correction in the detecting unit 22 is performed using the reflection pattern RP, it is possible to suppress a variation in detection result of the detecting unit 22 according to a use of the printing apparatus 10.

In addition, according to the embodiment, changes may be made as follows.

It is assumed that an absolute value of a difference between reflectivity of a medium M and reflectivity of the support face 312 is set to a difference in reflectivity ΔRR. Then a detection signal when the medium M is set to a detecting target easily becomes the first signal which is a detection signal when the medium M is not supported on the support face 312, since the difference in reflectivity ΔRR becomes small when both the medium M and the support face 312 are white colors, or black colors. That is, it can also be said that, when the difference in reflectivity ΔRR is large, a detection accuracy of the detecting unit 22 is high, and when the difference in reflectivity ΔRR is small, a detection accuracy of the detecting unit 22 is low.

Accordingly, when printing is performed on a medium M of which difference in reflectivity from that of the support face 312 is small, error information denoting that a medium M is not supported on the support face 312 is frequently generated, and throughput in the printing apparatus 10 easily decreases. Therefore, in a case in which the first signal is output from the detecting unit 22, when the above described difference in reflectivity ΔRR is less than a determination value ΔRRth, executing of printing operation may be allowed. In addition, in this case, whether or not to execute printing operation may be determined based on a variable (flag FLG) which selects whether or not to allow executing of a printing operation.

Here, it is preferable that the determination value ΔRRth is a constant which is a threshold value when making a determination, and is obtained in advance through an experiment, or the like. In addition, it is preferable that the difference in reflectivity ΔRR is input by a user in advance, or a detecting operation for detecting the difference in reflectivity ΔRR is separately performed. In addition, "1" is set in the flag FLG when a printing operation is executed, and "0" is set when executing of the printing operation is limited.

Hereinafter, a process routine which is performed by the second control unit 62 in this case will be described with reference to the flowchart illustrated in FIG. 9. In addition, in the flowchart illustrated in FIG. 9, common portions to the flowchart illustrated in FIG. 8 will be omitted.

Figure 9:
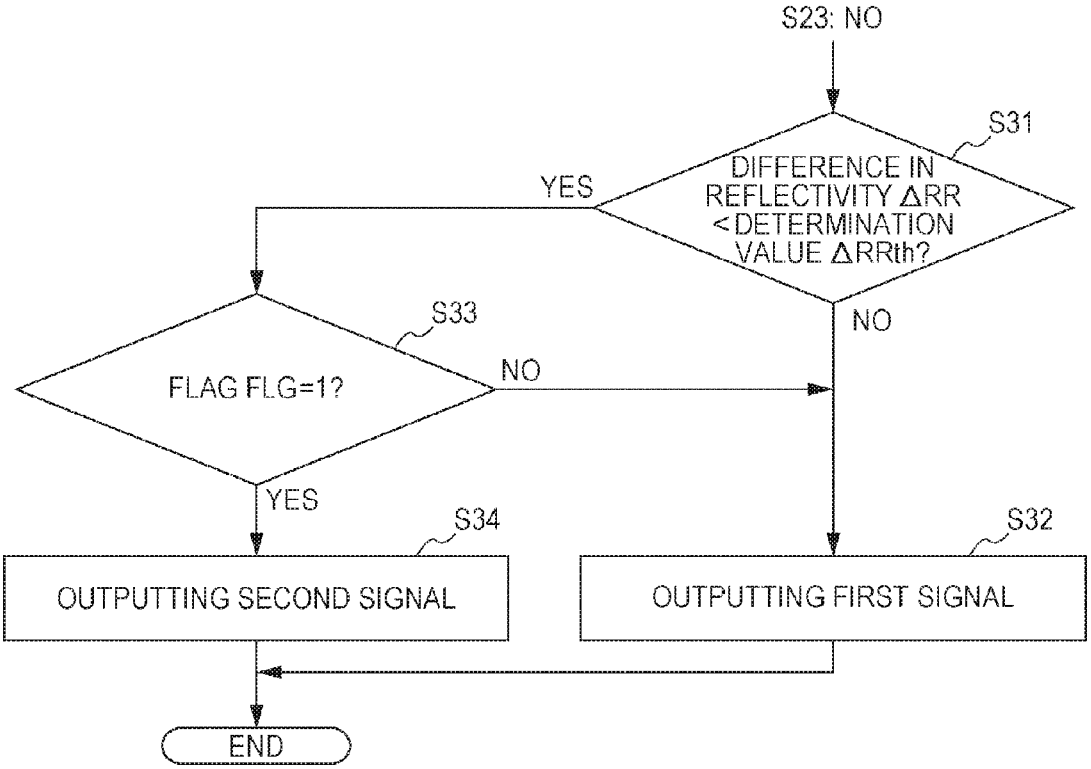
FIG. 9 is a flowchart which illustrates a processing routine executed by a second control unit according to a modification example which is performed when performing printing on a medium.

As illustrated in FIG. 9, when a detection signal is not the second signal (No in step S23), the second control unit 62 determines whether or not the difference in reflectivity ΔRR between the medium M and the support face 312 is less than the determination value ΔRRth (step S31). When the difference in reflectivity ΔRR is the determination value ΔRRth or more (No in step S31), that is, when a detection accuracy of the detecting unit 22 is high, and it is certainly the first signal, the second control unit 62 outputs the first signal to the second control unit 62 (step S32). Thereafter, the second control unit 62 temporarily ends the process.

Meanwhile, in step S31, when the difference in reflectivity ΔRR is less than the determination value ΔRRth (Yes in step S31), that is, when a detection accuracy of the detecting unit 22 is low, and it may not be the first signal, the second control unit 62 determines whether or not "1" is set in the flag FLG (step S33). When "0" is set in the flag FLG (No in step S33), the second control unit 62 proceeds the process to step S32. On the other hand, when "1" is set in the flag FLG (Yes in step S33), the second control unit 62 outputs the second signal to the first control unit 61 (step S34), and temporarily ends the process.

According to the configuration, when the difference in reflectivity ΔRR is large, and the detecting unit 22 can properly output the second signal, it is possible to causes a printing operation to be executed. In addition, when the difference in reflectivity ΔRR is small, and the detecting unit 22 may erroneously output the first signal, it is possible to prevent executing of a printing operation from being limited when the second control unit 62 outputs the second signal to the first control unit 61. In addition, when the difference in reflectivity ΔRR is small, and the detecting unit 22 may erroneously output the first signal, it is possible to cause a user to select whether or not to forcibly execute a printing operation using the flag FLG.

In the above described embodiment, the detecting unit 22 outputs a detection signal to the second control unit 62, and the second control unit 62 outputs the output signal to the first control unit 61; however, it is not limited to this. That is, the detecting unit 22 may directly output the detection signal to the first control unit 61. In this case, it is preferable that the first control unit 61 determines whether or not to execute printing based on the output signal from the second control unit 62, not the detection signal which is output from the detecting unit 22 (step S14).

The second control unit 62 may not determine which signal to output according to the allowed time zone Ta. That is, in the flowchart which is illustrated in FIG. 8, the process in step S21, and the determination process in step S25 may be omitted.

The second control unit 62 may not determine which signal to output according to a type of a printing instruction. That is, in the flowchart which is illustrated in FIG. 8, the determination process in step S26 may be omitted.

Processes in steps S25, S26, S31, and S33 which are performed by the second control unit 62 may be performed by the first control unit 61. For example, when the process in step S26 is performed by the first control unit 61, it is not necessary for the second control unit 62 to determine whether a printing instruction is given through the operation unit 51 or is given through the transceiving unit 63, and it is not necessary to connect the operation unit 51 and the transceiving unit 63 to the input side interface of the second control unit 62. In addition, it is preferable that information which is stored in the storage unit 65 of the second control unit 62 is stored in the storage unit 64 of the first control unit 61.

The detecting unit 22 may not be an optical detecting unit 22. For example, it may be a configuration in which whether or not a medium M is supported on the medium support unit 30 is determined according to a detection signal of a displacement sensor which measures a displacement amount of a member to be detected, by providing the member to be detected which is displaced due to an own weight of a medium M when the medium M is on the support face 312, and is not displaced when there is no medium M on the support face 312, on the other hand. Also in this case, when a medium M is light weight, a displacement amount of the member to be detected is small, and there is a concern that it may be determined that the medium M is not supported, even when the medium support unit 30 supports the medium M.

The medium support unit 30 may be a unit which supports a medium M such as a sheet. In this case, it is preferable that the transport unit transports a medium M before being printed to the medium support unit 30, or transports a medium M which is printed from the medium support unit 30.

In the above described embodiment, the second control unit 62 also functions as a "signal output unit" which outputs the first signal or the second signal to the first control unit 61; however, it is not limited to this. That is, the second control unit 62 may control a signal which is output from the signal output unit by providing the signal output unit which outputs the first signal or the second signal in the first control unit 61, separately from the second control unit 62.

In addition, in this case, the second control unit 62 may not be provided. In addition, in this case, the signal output unit continuously outputs the second signal to the first control unit 61.

The reflection pattern RP may not be provided in the frame body 32. For example, when a medium M is mounted on the support face 312 of the mounting table 31 without providing the frame body 32, the reflection pattern RP may be formed in a region of the support face 312 on which the medium M is not mounted. In addition, the reflection pattern RP may not be provided in the medium support unit 30 at all.

Reflectivity on the front surface 322 of the frame body 32 may be larger than that of the reflection pattern RP. That is, there is no problem as long as a difference in light intensity ΔLV which is necessary for configuring the detecting unit 22 is obtained.

The printing apparatus 10 may not be a serial printer which ejects ink while reciprocating in the width direction X of a medium M as in the embodiment. For example, it may be a line printer which ejects ink in a state in which the liquid droplet ejecting unit 21 is arranged by being fixed with a length corresponding to the entire width of a medium M.

The printing apparatus 10 may be a liquid droplet ejecting apparatus which ejects liquid droplets onto a medium M which is supported by the medium support unit 30 for a purpose other than printing.

Liquid droplets which are ejected from the liquid droplet ejecting unit 21 are not limited to ink, and may be a liquid body, or the like, in which particles of a functional material are dispersed or mixed in liquid, for example. For example, the liquid droplet ejecting unit may be a unit which ejects a liquid body including a material such as an electrode material which is used when manufacturing a liquid crystal display, an electroluminescence (EL) display, a surface light emitting display, and the like, or a coloring material (pixel material) in a form of dispersion or melting.

The medium M is not limited to cloth such as a T-shirt, may be a plastic film, a thin plate material, or the like, and may be other materials.

What is claimed is:

1. A liquid droplet ejecting apparatus comprising:

a medium support unit having a support face configured to support a medium;

a liquid droplet ejecting unit configured to execute an ejecting operation in which liquid droplets are ejected onto the medium while the medium is supported by the medium support unit;

a detecting unit configured to output a first signal which denotes that the medium is not supported on the support face, and a second signal which denotes that the medium is supported on the support face; and a control unit configured to limit executing of the ejecting operation when the first signal is input, and on the other hand, to allow executing of the ejecting operation when the second signal is input, wherein the control unit includes a signal output unit which can output the second signal, wherein the control unit is configured to allow executing of the ejecting operation when the second signal is input from the signal output unit even when the detecting unit outputs the first signal, and wherein the control unit is configured to perform a correction to operation of the detecting unit based on a difference between repeating high and low levels of a signal detected by the detecting unit, wherein the repeating high and low levels provide a reference when determining whether the medium is supported on the support face.

2. The liquid droplet ejecting apparatus according to claim 1, wherein the detecting unit is configured to radiate light toward a detecting target, detect a light intensity of reflected light from the detecting target, and output the first signal or the second signal corresponding to the light intensity of the reflected light.

3. The liquid droplet ejecting apparatus according to claim 2, wherein the medium support unit has a reflection pattern configured to receive the radiated light from the detecting unit.

4. A liquid droplet ejecting apparatus comprising:

a medium support unit having a support face configured to support a medium;

a liquid droplet ejecting unit configured to execute an ejecting operation in which liquid droplets are ejected onto the medium;

a detecting unit configured to output a first signal which denotes that the medium is not supported on the support face, and a second signal which denotes that the medium is supported on the support face; and a control unit configured to limit executing of the ejecting operation when the first signal is input, and on the other hand, to allow executing of the ejecting operation when the second signal is input, wherein the control unit includes a signal output unit which can output the second signal, wherein the control unit is configured to allow executing of the ejecting operation when the second signal is input from the signal output unit even when the detecting unit outputs the first signal, and wherein the signal output unit is configured to output a signal that includes repeating high and low levels, wherein the repeating high and low levels provide a reference when determining whether the medium is supported on the support face.

* * * * *